US009781975B2

(12) United States Patent
Dykema

(10) Patent No.: US 9,781,975 B2
(45) Date of Patent: Oct. 10, 2017

(54) FOOTWEAR SECUREMENT SYSTEM

(71) Applicant: Russell J. Dykema, Waterford, CT (US)

(72) Inventor: Russell J. Dykema, Waterford, CT (US)

( * ) Notice: Subject to any disclaimer, the term of this patent is extended or adjusted under 35 U.S.C. 154(b) by 0 days.

(21) Appl. No.: 15/191,973

(22) Filed: Jun. 24, 2016

(65) Prior Publication Data

US 2017/0006971 A1 Jan. 12, 2017

Related U.S. Application Data

(60) Provisional application No. 62/231,387, filed on Jul. 6, 2015.

(51) Int. Cl.
*A43C 11/00* (2006.01)
*A43C 7/00* (2006.01)

(52) U.S. Cl.
CPC ..... *A43C 11/006* (2013.01); *A43C 7/00* (2013.01)

(58) Field of Classification Search
CPC ..... A43C 11/006; A43C 7/00
See application file for complete search history.

(56) References Cited

U.S. PATENT DOCUMENTS 819,993 A * 5/1906 Haws ..... A43C 7/04 24/134 R
1,371,334 A * 3/1921 Toyama ..... A43C 7/00 24/575.1
3,934,346 A * 1/1976 Sasaki ..... A43C 1/003 36/138
5,388,315 A * 2/1995 Jones ..... A43B 3/0078 24/712.1
5,535,531 A * 7/1996 Karabed ..... A43C 7/00 24/714.6
6,622,358 B1 * 9/2003 Christy ..... A43C 7/00 24/712.9
7,950,112 B2 * 5/2011 Hammerslag ..... A43B 5/16 24/68 SK
9,149,089 B2 * 10/2015 Cotterman ..... A43C 3/00
2003/0177662 A1 * 9/2003 Elkington ..... A43C 1/00 36/50.1
2005/0126043 A1 * 6/2005 Reagan ..... A43B 3/0031 36/50.5
2005/0273988 A1 * 12/2005 Christy ..... A43C 7/00 24/712.1
2011/0047842 A1 * 3/2011 Brissenden ..... A43C 9/02 40/636
2011/0302748 A1 * 12/2011 Avelar ..... A43C 7/00 24/306
2013/0097887 A1 * 4/2013 Robinson ..... A43B 23/0245 36/54

* cited by examiner

*Primary Examiner* — David Upchurch
(74) *Attorney, Agent, or Firm* — Alix, Yale & Ristas, LLP

(57) ABSTRACT

A footwear securement system employs a plurality of elastic, stretchable elongated tubes, each of which extend through opposed corresponding openings of the footwear. Retainers are slidably receivable on the tubes and releasably engageable against opposed sides of the footwear so as to secure the footwear to a wearer. The retainers are preferably lock washers. One end of each of the tubes is preferably tapered.

15 Claims, 4 Drawing Sheets

FOOTWEAR SECUREMENT SYSTEM

CROSS-REFERENCE TO RELATED APPLICATION

This application claims the priority of U.S. Provisional Application No. 62/231,387 filed on Jul. 6, 2015, the disclosure of which in its entirety is incorporated herein by reference.

BACKGROUND

This application relates generally to devices and methods for securing footwear. More particularly, this application relates to devices and methods for securing shoes for wear and usage.

Over the years, footwear, including shoes, have been secured for usage by numerous devices and methods. For example, shoes are commonly secured by shoe laces threaded through openings or eyelets and tied in place. Buckles, Velcro™, fasteners, straps and various other devices have been conventionally employed for securing footwear. The desired features of any footwear securement system are ease in initially securing the footwear for usage, ease in removing the footwear after usage, and integrity of the securement during usage.

SUMMARY

Briefly stated, in one preferred form, a securement system for a shoe having opposed rows of corresponding opening comprises at least one elongated tube having opposed ends with one end being tapered. Each said tube extends through a pair of corresponding openings. A first retainer is received on each tube proximate one end and is generally fixed at a first position on the tube. A second retainer is received on the tube and slidably positionable to a second generally fixed releasable position. The first and second retainers are selectively spaced at fixed positions on each tube to secure the shoe on a wearer. The elongated tube is stretchable and is composed of an elastic flexible material. The first and second retainers are each preferably lock washers. Preferably, each tube has substantially the same length and may be formed from segments of medical tubing which has a generally uniform diameter. The retainers are substantially identical. Preferably, there are multiple tubes. Each tube is preferably tapered at one end portion. The lock washers have retention teeth which are dimensioned to engage the exterior surface of the tube but allow for sliding longitudinal displacement along the tube.

DETAILED DESCRIPTION

Figure 1:
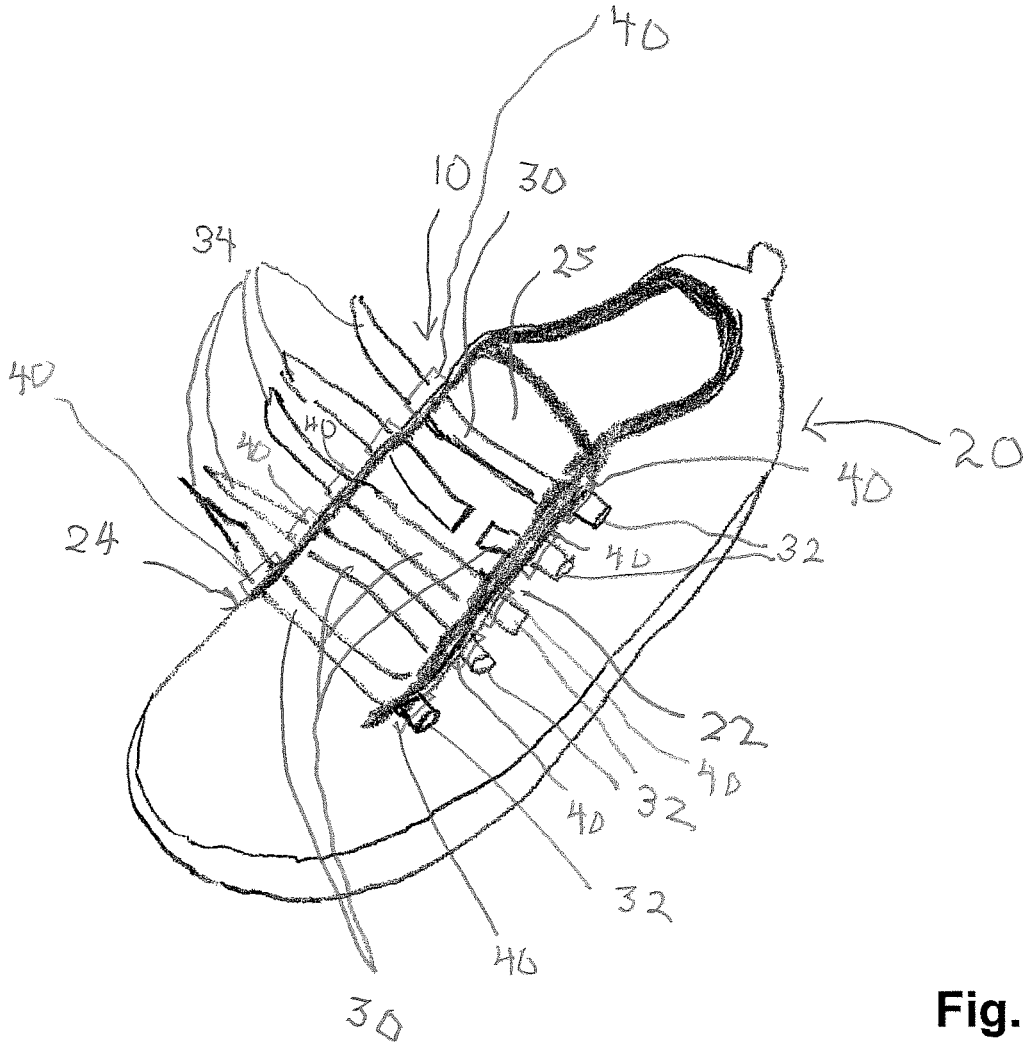
FIG. 1 is a perspective view of a shoe employing one embodiment of the footwear securement system.

With reference to the drawings wherein like numerals represent like parts throughout the several figures, a footwear securement system is generally designated by the numeral 10. The footwear securement system provides an efficient means for securing the footwear for usage and efficient means for removing the footwear after usage while also providing a securement system which is functional and provides a high integrity securement during usage.

The footwear securement system 10 is illustrated in conjunction with a conventional shoe 20 having two opposed sides 22 and 24 having opposed rows of generally aligned openings 26 and 28, respectively. A tongue 25 may be generally interposed between the sides and openings. In conventional securement systems and techniques, a shoelace would be laced through the openings 26 and 28 and ultimately tightened and secured by a knot such as a conventional bow.

The footwear securement system 10 employs a plurality of flexible or semi-flexible tubes which have opposed ends 32 and 34. Preferably, the tubes are substantially identical, although it is not required for the system. One of the ends of the tube is preferably tapered or pointed for ease of inserting the tube through an opening in one row and for insertion through a corresponding opening in another row. A preferred form of a tube 30 is a segment of a latex medical tubing having a uniform inside diameter of 3/16 inches and a uniform outside diameter of 5/16 inches. It will be appreciated that each tube 30 has a certain degree of longitudinal and radial elasticity.

Figure 2:
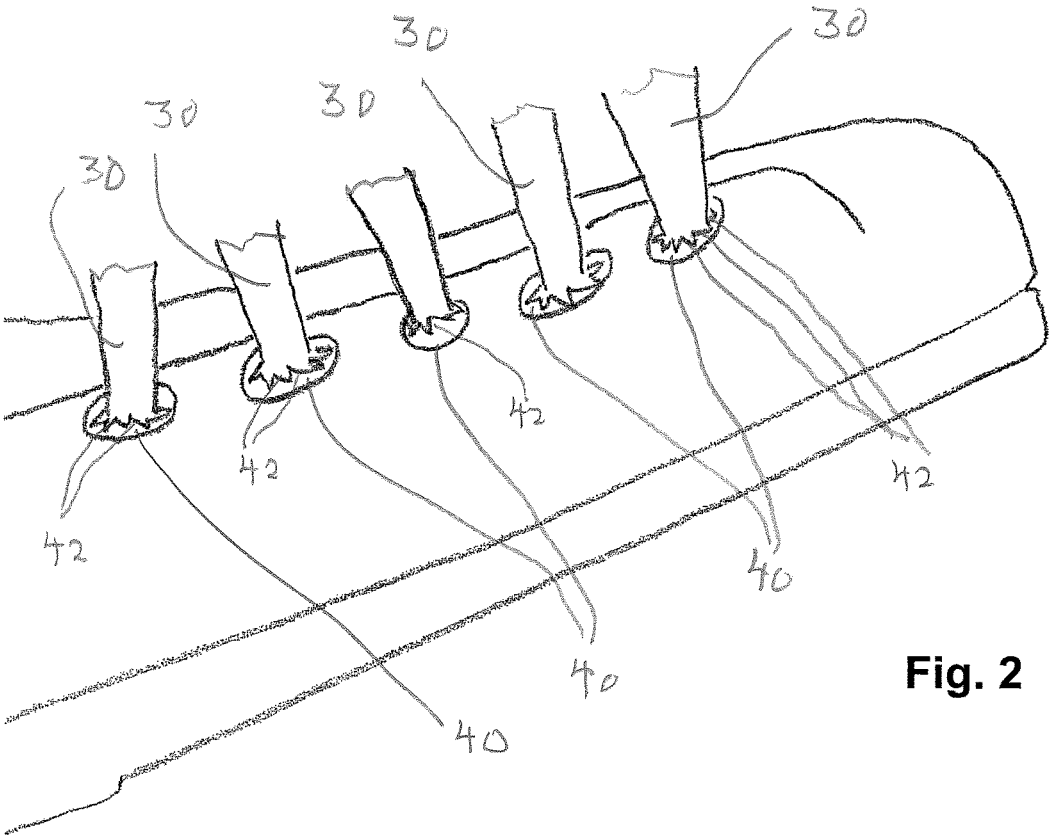
FIG. 2 is an enlarged fragmentary side view of the shoe and footwear securement system.
Figure 3:
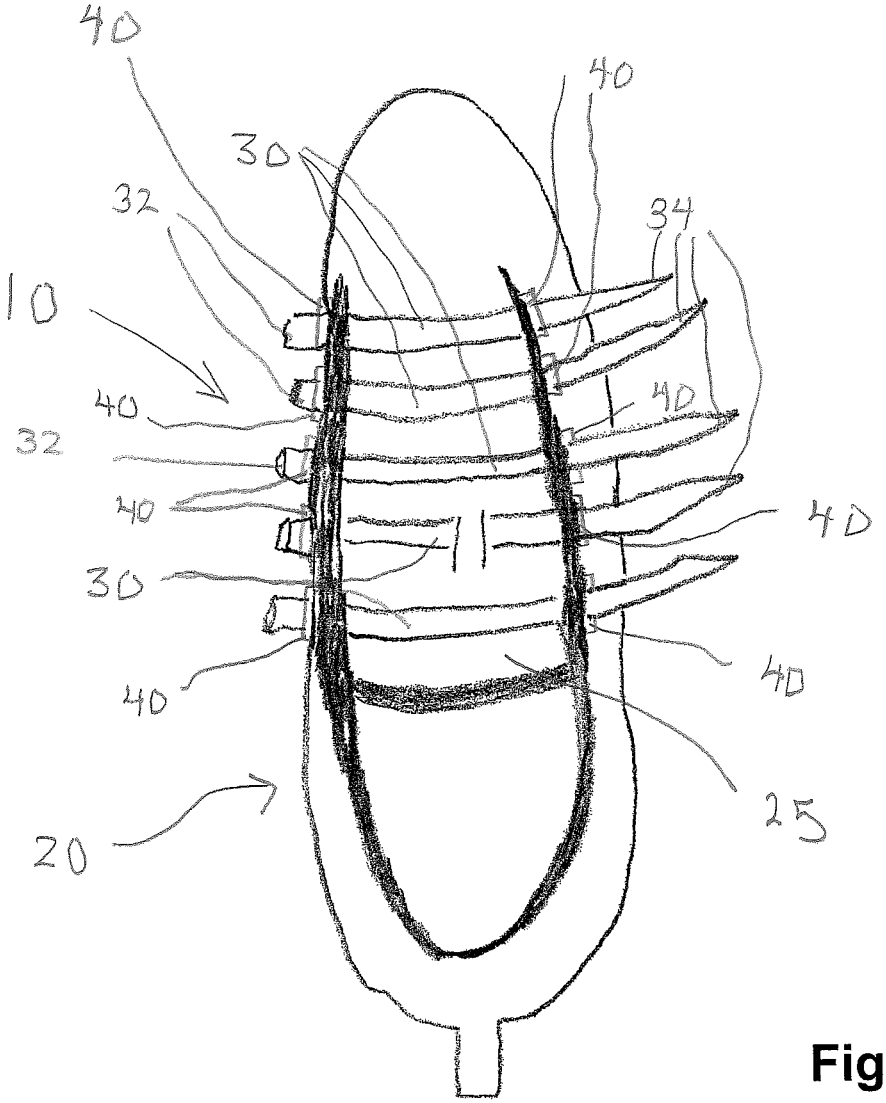
FIG. 3 is a top plan view of the shoe and footwear securement system of FIG. 1.
Figure 4:
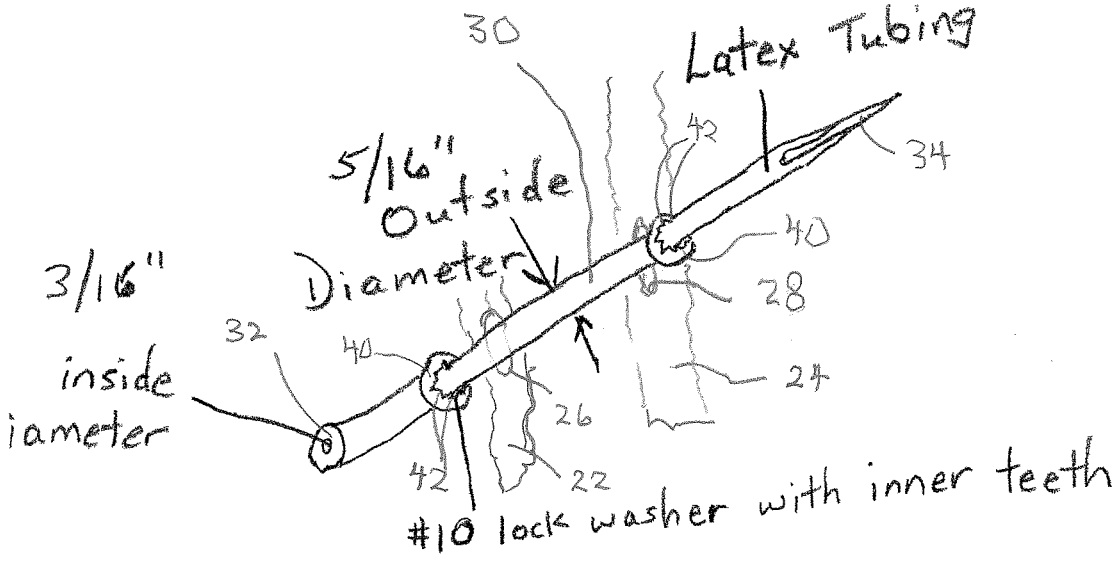
FIG. 4 is an annotated diagrammatic view of a portion of the footwear securement system of FIG. 1.

A series of the tubes 30 are inserted through opposed corresponding openings 26 and 28 in the shoe. The tubes are secured by retainers in the form of lock washers 40 which inwardly engage against the tube and also are longitudinally moved to engage against the side of the shoe. The washers 40 each have inward an inward circular array of teeth 42 which are dimensioned to engage into the exterior surface of the tube 30 (See FIG. 2). Once positioned, the washers 40 remain essentially fixed in position due to both inner radial engagement or pinching of the washer and the elasticity or memory function of each tube 30. One preferred retainer 40 is a #10 lock washer with inner locking teeth. A washer 40 is mounted at each of the sides outwardly adjacent the sides of the shoe. Upon installation, the tubes 30 form a quasi-parallel lattice.

In a preferred practice of the invention, all of the portions of the tube on one side of a row of openings are affixed with retainers which are pre-positioned against the side 22 of the shoe. The other side of the tube mounts the retainers which are slidably positionable against the other side 24 of the shoe to tighten (reduce) the spacing between the shoe sides and are also longitudinally moveable along the tube to loosen the securement of the shoe.

Accordingly, when it is desired to put on the shoe, the tube retainers 40 are loosened (if not already loosened). The foot is inserted into the shoe and secured by forcing the retainers against the side of the shoe. The elasticity of the tubes and engagement of the washer lock teeth 42 function to secure the retainers in position.

It will be appreciated that the shoes can be put on and secured in a relatively efficient and quick process by merely sequentially positioning one retainer 40 on each tube 30 on the shoe. In the illustrated embodiment, five tubes are employed. In practice one, two or any number of tubes may be employed. The number of tubes is preferably equal to the number of openings in each row or side of the shoe.

While the preferred embodiments of the foregoing have been set for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A securement system for a shoe having spaced sides with opposed rows of corresponding openings comprising:

at least one elongated tube having opposed ends with one end being tapered;

said at least one tube extending through a pair of corresponding openings with opposed free ends extending generally outwardly beyond said openings;

a first retainer received on said tube proximate one end and being generally fixed at a first position on said tube;

a second retainer received on said tube and slidably positionable to a second generally fixed releasable position, wherein said first and second retainers may be selectively spaced at fixed positions against said sides to secure said shoe on a wearer.

2. The securement system of claim 1 wherein said elongated tube is composed of an elastic flexible or semi-flexible material.

3. The securement system of claim 1 wherein said second retainer is a lock washer.

4. The securement system of claim 1 wherein said first and second retainers are each lock washers.

5. The securement system of claim 1 wherein each said tube has substantially the same length.

6. The securement system of claim 1 wherein said retainers are substantially identical.

7. The securement system of claim 1 wherein there are a plurality of tubes which form a lattice.

8. A securement system for footwear wherein said footwear has a tongue and a pair of opposed sides adjacent said tongue with said sides each having a plurality of openings, comprising:

a plurality of elongated tubes each having opposed ends;

each said tube extending through an opening on each said side with opposed free ends extending generally outwardly beyond said sides;

a first retainer received on each said tube proximate one end and being generally fixed at a first position on said tube engaging a side portion adjacent said opening;

a second retainer received on each said tube and slidably positionable to a second generally fixed releasable position adjacent an opening in an opposed side;

wherein said first and second retainers are selectively spaced at outwardly fixed positions against said opposed sides to secure said footwear on a wearer.

9. The securement system of claim 8 wherein said elongated tube is longitudinally stretchable and has a resilient elastic composition.

10. The securement system of claim 9 wherein said tubes each have a tapered portion adjacent one end.

11. The securement system of claim 8 wherein said first and second retainers are substantially identical lock washers having retention teeth which are dimensioned to lockably engage the tube.

12. The securement system for footwear wherein said footwear has a pair of opposed sides wherein each side defines a row of openings comprising:

a plurality of elongated members of substantially uniform diameter and longitudinally and radially elastically deformable with opposed ends extending outwardly through an opening on each said side;

a lock washer slidably received on each said member proximate one end and being generally fixed at a first outward position on said member engaging a portion of said side adjacent said opening;

a second lock washer received on each said member and slidably positionable to a second generally fixed releasable position adjacent an opening of an opposed side and engaging a side portion adjacent said opening;

wherein said first and second retainers are selectively spaceable at fixed outward positions against said opposed sides to secure said footwear on a wearer.

13. The securement system of claim 12 wherein each said elongated member is formed from segments of a latex medical tubing.

14. The securement system of claim 12 wherein said members each have a tapered portion adjacent one end.

15. The securement system of claim 12 wherein said first and second lock washers are substantially identical and are dimensioned to slightly engage against the exterior surface of each said elongated member.

* * * * *